US009017011B2

(12) United States Patent
Gatley, Jr. et al.

(10) Patent No.: US 9,017,011 B2
(45) Date of Patent: Apr. 28, 2015

(54) FURNACE AIR HANDLER BLOWER WITH ENLARGED BACKWARD CURVED IMPELLER AND ASSOCIATED METHOD OF USE

(75) Inventors: William Stuart Gatley, Jr., Cassville, MO (US); Steven W. Post, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 526 days.

(21) Appl. No.: 13/355,239

(22) Filed: Jan. 20, 2012

(65) Prior Publication Data

US 2013/0170945 A1 Jul. 4, 2013

Related U.S. Application Data

(60) Provisional application No. 61/581,559, filed on Dec. 29, 2011.

(51) Int. Cl.

*F04D 29/40* (2006.01)
*F04D 29/42* (2006.01)
*F04D 17/16* (2006.01)

(52) U.S. Cl.

CPC ..... *F04D 29/422* (2013.01); *F04D 17/162* (2013.01); *F04D 29/4226* (2013.01)

(58) Field of Classification Search

CPC . F04D 29/4226; F04D 29/422; F04D 17/162; F04D 29/162

USPC ..... 415/1, 60, 65, 66, 98, 99, 102, 103, 415/107, 204, 206, 211.1; 416/238; 417/423.7, 420

See application file for complete search history.

(56) References Cited

U.S. PATENT DOCUMENTS 17,664 A 6/1857 Braugh
82,736 A 10/1868 Mitchell (Continued)

FOREIGN PATENT DOCUMENTS

DE 19709193 A1 10/1997
JP 61138900 A 6/1986

(Continued)

OTHER PUBLICATIONS

International Search Report and Written Opinion of the International Searching Authority for PCT Application No. PCT/US2011/044702 dated Dec. 22, 2011.

(Continued)

*Primary Examiner* — Edward Look
*Assistant Examiner* — Jason Davis
(74) *Attorney, Agent, or Firm* — Thompson Coburn LLP

(57) ABSTRACT

A blower having a blower housing having a cutoff and a top portion with an air outlet opening, a fan within the blower housing, the fan being adapted for rotation about a fan axis and having an outer diameter with a distance between the outer diameter of the fan and the top portion of the air outlet opening extending along a vertical line between the fan axis and the air outlet opening being less than seventy-five percent of the distance between the outer diameter of the fan and the cutoff of the blower housing extending along a line between the fan axis and the cutoff, and a motor having a stator and a rotor, the rotor being rotatably coupled to the stator for rotation about the fan axis, the rotor and fan being coupled such that the fan rotates with the rotor.

24 Claims, 9 Drawing Sheets

(56) References Cited

U.S. PATENT DOCUMENTS 662,395 A 11/1900 Davidson
675,375 A 6/1901 Davidson
801,304 A 10/1905 Davidson
839,273 A 12/1906 Davidson
866,887 A 9/1907 Robinson
RE12,796 E 5/1908 Davidson
RE12,797 E 5/1908 Davidson
RE12,798 E 5/1908 Davidson
1,031,180 A 7/1912 Hancock
1,111,250 A 9/1914 Davidson
1,138,083 A 5/1915 Carrier
1,282,065 A 10/1918 Froelich
1,462,557 A 7/1923 Kuenzel, Jr.
1,483,995 A 2/1924 Taylor
1,637,652 A 8/1927 Ness
1,875,881 A 9/1932 Morse
1,877,905 A 9/1932 le Grand
1,892,930 A 1/1933 Burman
1,895,488 A 1/1933 Reisinger
1,935,120 A 11/1933 Hagen
2,083,996 A 6/1937 Jonn
2,155,631 A 4/1939 Anderson
2,165,069 A 7/1939 Reynolds
2,225,398 A 12/1940 Hamblin
2,301,857 A 11/1942 Criqui
2,322,357 A 6/1943 Hagen
2,441,411 A 5/1948 Hagen
2,564,775 A 8/1951 Besser
2,649,242 A 8/1953 Payne
2,823,852 A * 2/1958 Busch ..... 417/350
2,976,352 A * 3/1961 Atalla ..... 417/350
3,098,603 A 7/1963 Baker
3,154,242 A 10/1964 Harris
3,191,851 A 6/1965 Wood
3,227,150 A 1/1966 Reznick et al.
3,275,223 A 9/1966 Fowell
3,332,612 A 7/1967 Gross
3,382,862 A 5/1968 Martz
3,407,995 A 10/1968 Kinsworthy
3,481,321 A 12/1969 Reichelderfer
3,491,550 A 1/1970 Cavis
3,561,906 A 2/1971 Fermer
3,619,088 A 11/1971 Bullock
3,638,636 A 2/1972 Marshall et al.
3,746,464 A 7/1973 Goettl
3,775,029 A 11/1973 Ranz
3,820,526 A 6/1974 Van Vliet
3,846,040 A 11/1974 Dennis
3,950,835 A 4/1976 Bennink et al.
4,035,610 A 7/1977 Roth
4,309,977 A 1/1982 Kitchen
4,419,049 A 12/1983 Gerboth et al.
4,424,006 A 1/1984 Armbruster
4,526,506 A * 7/1985 Koger et al. ..... 415/98
4,828,456 A 5/1989 Bodzian et al.
4,917,572 A 4/1990 Van Houten
5,141,397 A 8/1992 Sullivan
5,178,124 A 1/1993 Lu et al.
5,257,904 A 11/1993 Sullivan
5,301,654 A 4/1994 Weber, III et al.
5,309,890 A 5/1994 Rieke et al.
5,368,010 A 11/1994 Weber, III et al.
5,375,586 A 12/1994 Schumacher et al.
5,377,662 A 1/1995 Mills et al.
5,379,750 A 1/1995 Larsen et al.
5,379,751 A 1/1995 Larsen et al.
5,380,193 A 1/1995 Williams et al.
5,406,933 A 4/1995 Lu
5,427,503 A 6/1995 Haraga et al.
5,448,986 A 9/1995 Christopher et al.
5,570,996 A 11/1996 Smiley, III
5,601,400 A 2/1997 Kondo et al.
5,813,834 A 9/1998 Hopfensperger et al.
6,030,173 A * 2/2000 Bacchiocchi ..... 415/98
6,076,795 A 6/2000 Scheidel et al.
6,273,679 B1 8/2001 Na
6,296,478 B1 10/2001 Gatley, Jr.
6,314,894 B1 11/2001 Gatley, Jr.
6,318,358 B1 11/2001 Gatley, Jr.
6,352,431 B1 3/2002 Gatley, Jr.
6,439,839 B1 8/2002 Song et al.
6,468,034 B1 10/2002 Garrison et al.
6,494,152 B2 12/2002 Gatley, Jr.
6,511,290 B1 1/2003 Gatley, Jr.
6,578,629 B1 6/2003 Trent
6,585,484 B2 7/2003 Rosenthal et al.
6,595,146 B2 7/2003 Gatley, Jr.
6,767,184 B2 7/2004 Kim et al.
6,821,088 B2 11/2004 Sakai et al.
6,881,031 B2 4/2005 Nomura
6,895,874 B2 5/2005 Gatley, Jr.
6,902,373 B1 6/2005 Glanton
6,908,281 B2 6/2005 Lyons et al.
6,929,448 B1 8/2005 Lyons et al.
6,951,241 B1 10/2005 Gatley
6,953,319 B2 10/2005 Sohn et al.
7,014,422 B2 3/2006 Hancock
7,112,910 B2 9/2006 Lopatinsky et al.
7,182,574 B2 2/2007 Lyons
7,206,724 B2 * 4/2007 Chen ..... 703/1
7,210,903 B2 5/2007 Lyons
7,334,986 B2 2/2008 Sohn et al.
7,338,256 B2 3/2008 Kuo et al.
7,431,642 B2 10/2008 Herbst
7,500,825 B2 3/2009 Hanai
7,549,842 B2 6/2009 Hanson et al.
8,025,049 B2 9/2011 Post
2002/0014233 A1 2/2002 Gatley et al.
2002/0064457 A1 5/2002 Pauly
2003/0012649 A1 1/2003 Sakai et al.
2004/0062646 A1 4/2004 Nomura
2005/0019159 A1 1/2005 Lyons et al.
2005/0140233 A1 * 6/2005 Kojima et al. ..... 310/156.37
2006/0013684 A9 1/2006 Tamagawa et al.
2006/0024160 A1 2/2006 Horng et al.
2006/0034686 A1 2/2006 Smiley et al.
2006/0051205 A1 3/2006 Platz
2006/0083610 A1 4/2006 Hisaka et al.
2006/0165521 A1 7/2006 Kim
2007/0092373 A1 4/2007 Chen et al.
2007/0212218 A1 9/2007 Seki et al.
2007/0231130 A1 10/2007 Hanazuka et al.
2007/0274833 A1 11/2007 Sakai et al.
2008/0001488 A1 1/2008 Pyrhonen et al.
2008/0187439 A1 8/2008 Iyer
2008/0193285 A1 8/2008 Spaggiari
2008/0267774 A1 10/2008 Lian
2008/0310957 A1 12/2008 Lyons
2009/0114205 A1 5/2009 Post
2009/0114206 A1 5/2009 Post
2009/0252605 A1 10/2009 Lyons
2010/0078007 A1 4/2010 Post
2010/0263653 A2 10/2010 Post
2011/0217188 A1 9/2011 Lyons
2013/0216410 A1 * 8/2013 Patterson et al. ..... 417/420

FOREIGN PATENT DOCUMENTS

JP 2004143995 A 5/2004
WO 2012/012547 A1 1/2012

OTHER PUBLICATIONS

U.S. Appl. No. 60/943,955, filed Jun. 14, 2007 (Lyons).

* cited by examiner

FURNACE AIR HANDLER BLOWER WITH ENLARGED BACKWARD CURVED IMPELLER AND ASSOCIATED METHOD OF USE

CROSS-REFERENCE TO RELATED APPLICATION

This application claims priority of U.S. Provisional Patent Application No. 61/581,559 filed Dec. 29, 2011, which is hereby incorporated herein by reference in its entirety.

BACKGROUND OF THE INVENTION

A major problem with standard backward curved and backward inclined impellers utilized in a blower for a standard air handler, fan coils, and furnaces is that the noise and sound is too high to be acceptable to the consumer since these backward curved and backward inclined impellers must operate at a higher speed than a standard blower. To compound the issue, consumers also require significant energy savings over standard blowers.

The typical construction of a high efficiency furnace 10 is shown in FIG. 1. The furnace 10 has an external housing enclosure 12 with an interior volume 14. Several portions of the side walls of the furnace enclosure 12 shown in FIG. 1 have been removed to illustrate the interior components of the furnace. The dimensions of the furnace enclosure 12 are determined to contain all of the component parts of the furnace in the furnace enclosure 12, without the enclosure occupying a significant area in the residence in which the furnace is installed. In contrast, commercial furnaces are typically mounted on the roof of a building or at some other location outside the building where there are no size restraints. Because commercial furnaces with their large capacity are located outside the structures they serve, there is no need to position the component parts of the furnace relative to each other to minimize the size of the furnace enclosure as there is in residential furnaces.

An air inlet opening is typically provided in a side wall or in the bottom of the furnace enclosure. The air inlet opening can be covered by an air filter that allows ambient air in the environment surrounding the furnace enclosure 12 to easily pass through the opening and enter the enclosure interior 14. Alternatively and more frequently, the air inlet opening of the furnace enclosure communicates with a cold air return duct system of the residence. The cold air return duct system channels ambient air from throughout the residence to the furnace enclosure 12.

The furnace enclosure 12 also has an air distribution outlet opening 18. The outlet opening communicates with an air distribution conduit or duct system of the residence in which the furnace is installed. In FIG. 1, the air distribution outlet opening 18 is located at the top of the furnace enclosure 12. The air heated by the high efficiency furnace 10 is discharged to the air distribution conduit system (not shown) through the air distribution outlet opening 18.

In the typical construction of a high efficiency furnace represented in FIG. 1, a primary heat exchanger 22 is located at the top of the furnace enclosure 12 adjacent the air distribution outlet opening 18. A secondary heat exchanger 24 that qualifies the furnace as a high efficiency furnace is located directly below the primary heat exchanger 22.

An air distribution blower 26 that draws ambient air into the furnace enclosure 12 is positioned just below the secondary heat exchanger 24. A motor (not shown) of the blower rotates a fan wheel 28 in the interior of the blower in a clockwise direction as viewed in FIG. 1. This rotation of the fan wheel 28 draws the ambient air into the blower 26 as represented by the arrow labeled (AIR FLOW) in FIG. 1, and pushes the ambient air out of the blower 26 through the secondary heat exchanger 24, then through the primary heat exchanger 22, and then out of the enclosure through the air distribution outlet opening 18.

A typical blower 26 includes a blower housing that contains the fan wheel 28. The typical blower housing includes an exterior or outer wall 32. The outer wall 32 spirals around the fan wheel 28 in the direction of fan wheel rotation.

SUMMARY OF INVENTION

In another aspect of the invention, a blower is disclosed. The blower includes a blower housing having a cutoff and a top portion with an air outlet opening, a fan within the blower housing, the fan being adapted for rotation about a fan axis and having an outer diameter with a distance between the outer diameter of the fan and the top portion of the air outlet opening extending along a vertical line between the fan axis and the air outlet opening being less than seventy-five percent of the distance between the outer diameter of the fan and the cutoff of the blower housing extending along a line between the fan axis and the cutoff, and a motor having a stator and a rotor, the rotor being rotatably coupled to the stator for rotation about the fan axis, the rotor and fan being coupled such that the fan rotates with the rotor.

In another aspect of the invention, a blower is disclosed. The blower includes a blower housing having a cutoff and a top portion with an air outlet opening, a fan within the blower housing, the fan being adapted for rotation about a fan axis and having an outer diameter, the fan comprising a first set of backward curved impeller blades, and a second set of backward curved impeller blades, the first set of backward curved impeller blades being spaced axially from the second set of backward curved impeller blades and a distance between the outer diameter of the fan and the top portion of the air outlet opening extending along a vertical line between the fan axis and the air outlet opening being less than seventy-five percent of the distance between the outer diameter of the fan and the cutoff of the blower housing extending along a line between the fan axis and the cutoff and the angle between the vertical line extending between the fan axis and the air outlet opening and the line extending between the fan axis and the cutoff being at least ten degrees, a motor having a stator and a rotor, the rotor being rotatably coupled to the stator for rotation about the fan axis, the rotor and fan being coupled such that the fan rotates with the rotor, and a support member connected between the stator of the motor and the blower housing and extending generally radially from the fan axis, the support member supporting both the motor and the fan, the support member located between the first set of backward curved impeller blades and the second set of backward curved impeller blades.

Still yet another aspect of the present invention is that a method for utilizing a fan within the blower housing is disclosed. The method includes utilizing a fan within the blower housing, having a cutoff and a top portion with an air outlet opening, wherein the fan being adapted for rotation about a fan axis and having an outer diameter with a distance between the outer diameter of the fan and the top portion of the air outlet opening extending along a vertical line between the fan axis and the air outlet opening being less than seventy-five percent of the distance between the outer diameter of the fan and the cutoff of the blower housing extending along a line between the fan axis and the cutoff, and utilizing a motor having a stator and a rotor, the rotor being rotatably coupled to the stator for rotation about the fan axis, the rotor and fan being coupled such that the fan rotates with the rotor.

These are merely some of the innumerable aspects of the present invention and should not be deemed an all-inclusive listing of the innumerable aspects associated with the present invention. These and other aspects will become apparent to those skilled in the art in light of the following disclosure and accompanying drawings.

BRIEF DESCRIPTION OF DRAWINGS

For a better understanding of the present invention, reference may be made to the accompanying drawings in which.

Figure 1:
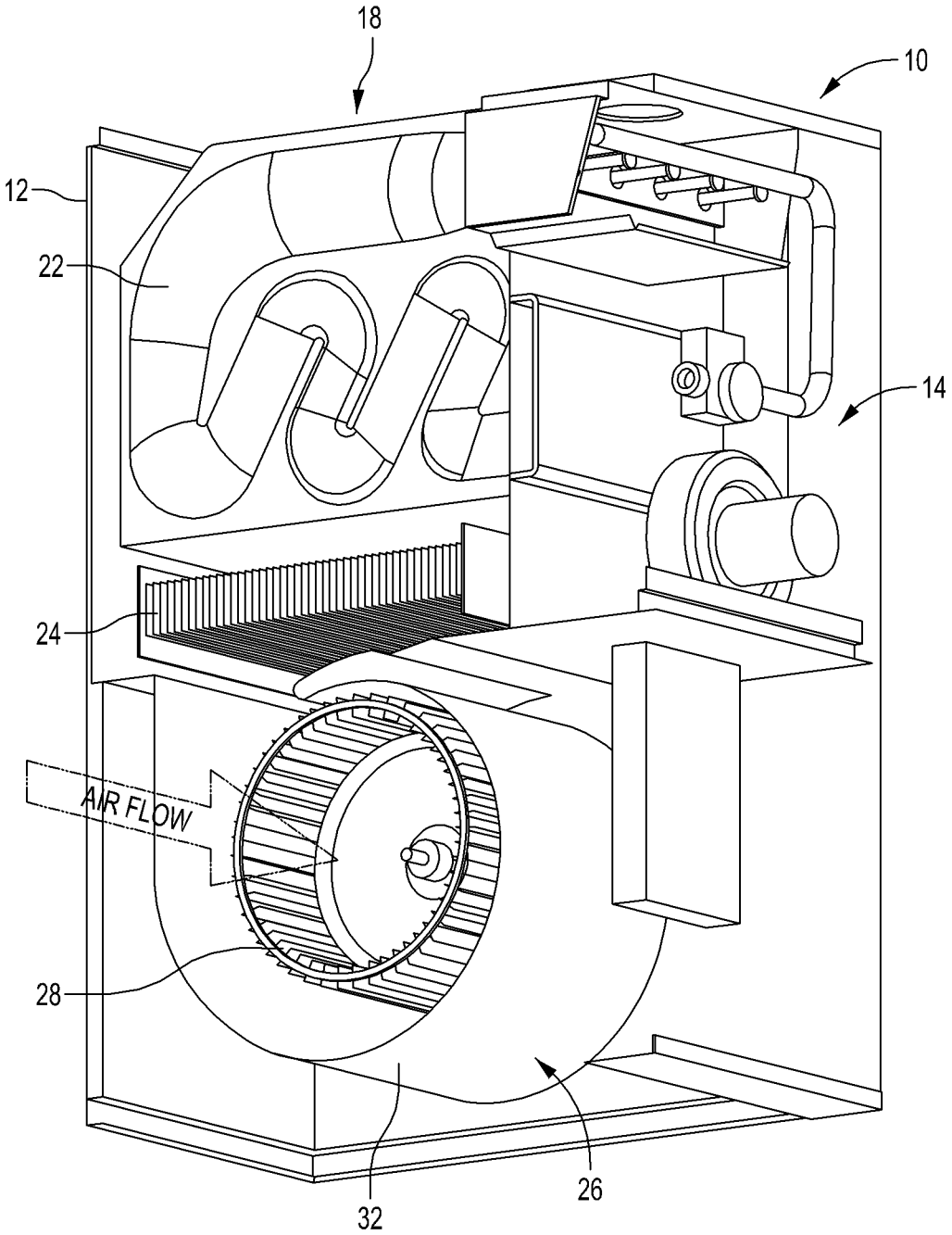
FIG. 1 (Prior Art)
FIG. 1 is a partial view of the construction of a prior art high efficiency furnace.

Reference characters in the written specification indicate corresponding items shown throughout the drawing figures.

DETAILED DESCRIPTION OF THE INVENTION

In the following detailed description, numerous specific details are set forth in order to provide a thorough understanding of the invention. However, it will be understood by those skilled in the art that the present invention may be practiced without these specific details. In other instances, well-known methods, procedures, and components have not been described in detail so as to obscure the present invention.

Figure 2:
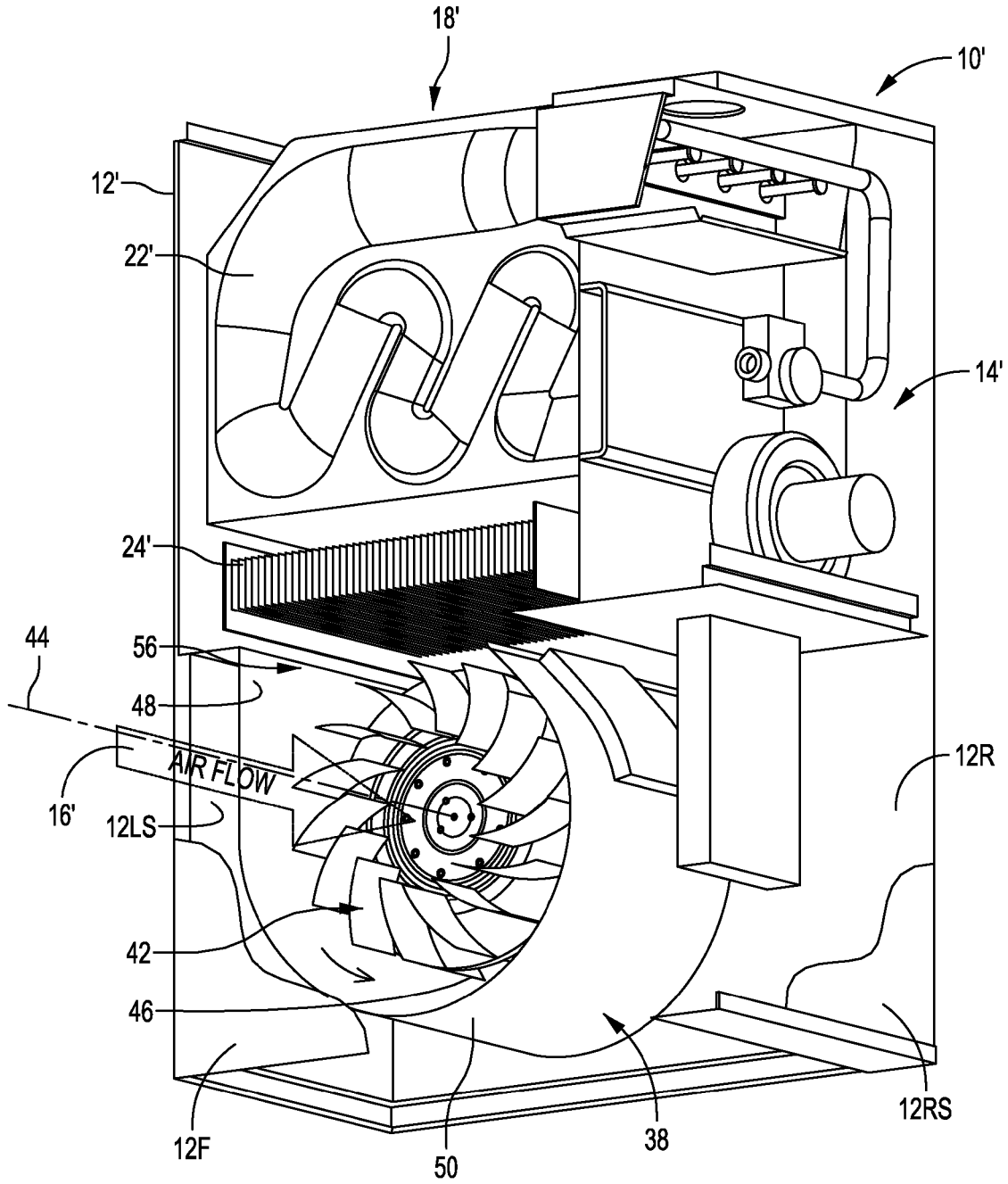
FIG. 2 is a partial view of the high efficiency furnace of FIG. 1 employing the unique blower with an enlarged backward curved impeller of the present invention.

Referring now to FIG. 2, which is a perspective, cut away view of the high efficiency furnace of the invention that employs an enlarged backward curved impeller. The furnace of the invention is primarily constructed in the same manner as known high efficiency furnaces. Because much of the construction of the furnace shown in FIG. 2 is the same as that of FIG. 1, the same component parts of the furnace of FIG. 2 will be described only generally and are identified by the same reference numbers used in identifying the component parts in FIG. 1, but with the reference numbers being followed by a prime (').

The high efficiency furnace 10' of the present invention also includes an external housing enclosure 12' that contains the interior volume 14' of the furnace 10'. Only a rear wall 12R and a left side wall 12LS of the external housing enclosure 12' are entirely shown in FIG. 2. The front wall 12F and right side wall 12RS are shown with portions removed to provide a view of the interior components of the furnace. It should be understood that the front and rear walls have the same width and height dimensions and the left side wall 12LS and the right side wall 12RS have the same width and height dimensions whereby the enclosure has the exterior configuration that may preferably, but not necessarily, have the shape of a rectangular cube. The front wall 12F of the external housing enclosure 12' or the bottom of the external housing enclosure 12' is provided with an air inlet opening that allows ambient air of the residence in which the furnace is used to enter into the enclosure interior 14'. The air inlet opening is often communicated with a cold air return duct system of the residence. Air that is heated by the furnace 10' is discharged to an air distribution conduit system of the residence (not shown) through an air distribution outlet opening 18'. The air distribution outlet opening 18' is positioned at the top of the external housing enclosure 12' shown in FIG. 2.

The primary heat exchanger 22' is positioned at the top of the enclosure interior volume 14' adjacent the air distribution outlet opening 18'. The secondary heat exchanger 24' is positioned just below the primary heat exchanger 22'. The use of both a primary heat exchanger and a secondary heat exchanger qualifies the furnace of the invention as a high efficiency furnace, or a 90+ AFUE furnace.

The blower 38 of the invention is positioned in the enclosure interior 14' at the same position as the prior art blower 26' shown in FIG. 1, i.e., just below the secondary heat exchanger 24'. The fan wheel 42 has an axis of rotation 44 that defines mutually perpendicular axial and radial directions relative to the blower 38. As shown in FIG. 2, the fan wheel 42 rotates in a clockwise rotation direction when the blower 38 is operating. Rotation of the fan wheel 42 draws ambient air into the blower 38 as represented by the arrow labeled (AIR FLOW) 16' in FIG. 2. In the preferred embodiment, the fan wheel 42 is comprised of a plurality of backward curved impeller blades 46. However, any type of a myriad of fan wheels and types of fans may be utilized with the present invention.

Figure 3:
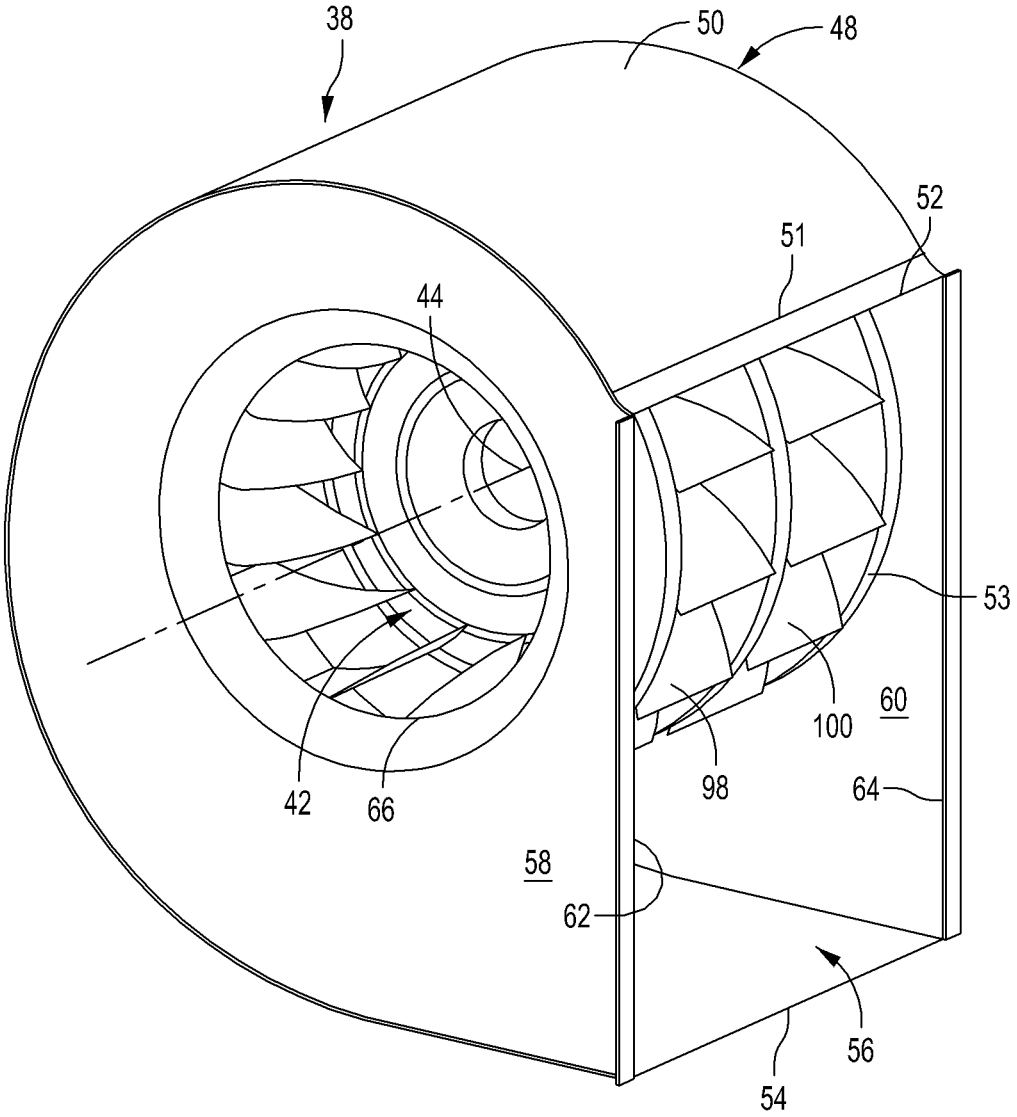
FIG. 3 is a back perspective view of the blower shown in FIG. 2.
Figure 4:
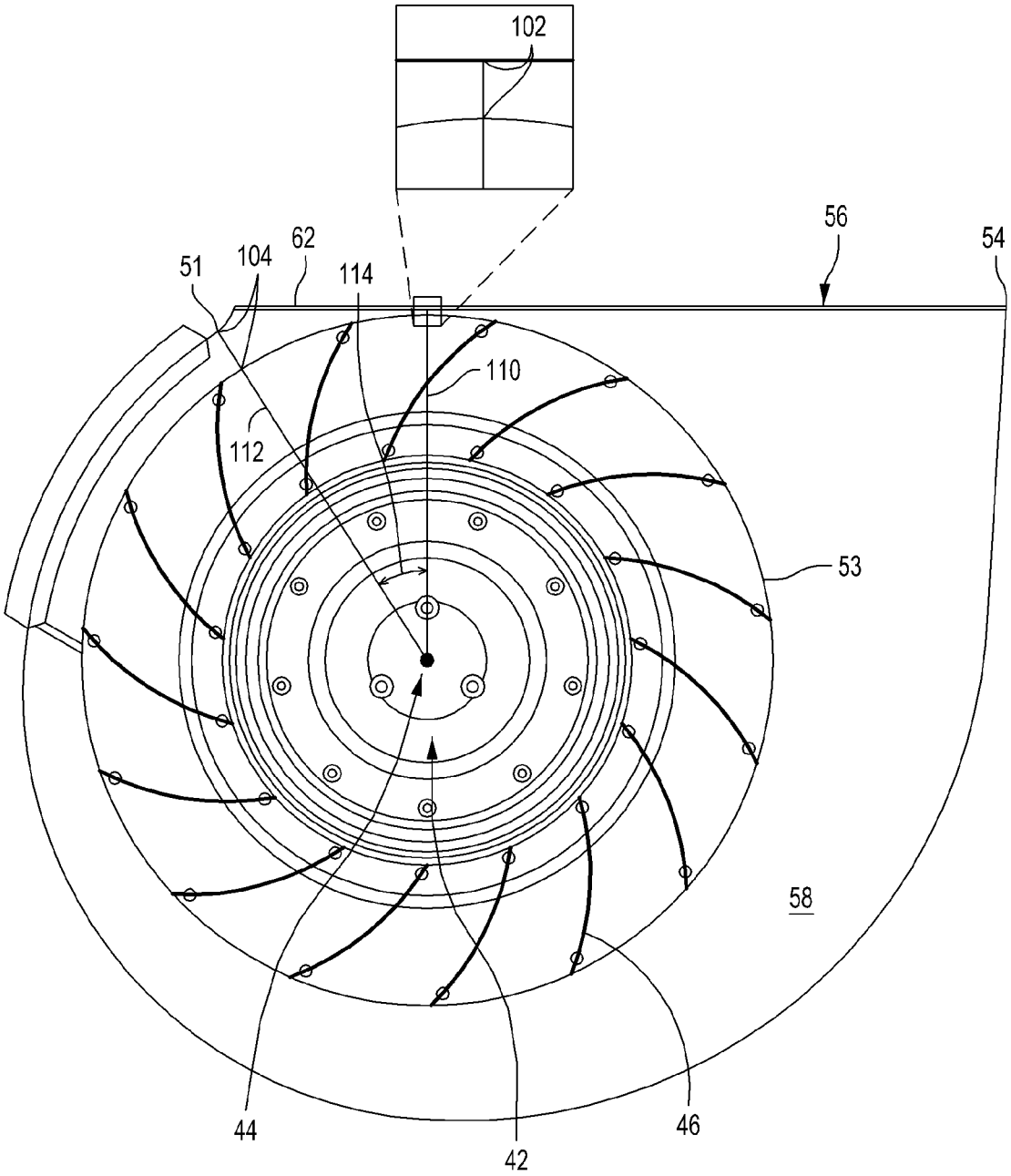
FIG. 4 is the perspective view of the blower shown in FIG. 3 with a first outer wall removed and an isolated view of a distance between the outer diameter of the impeller blades and an outlet opening.
Figure 5:
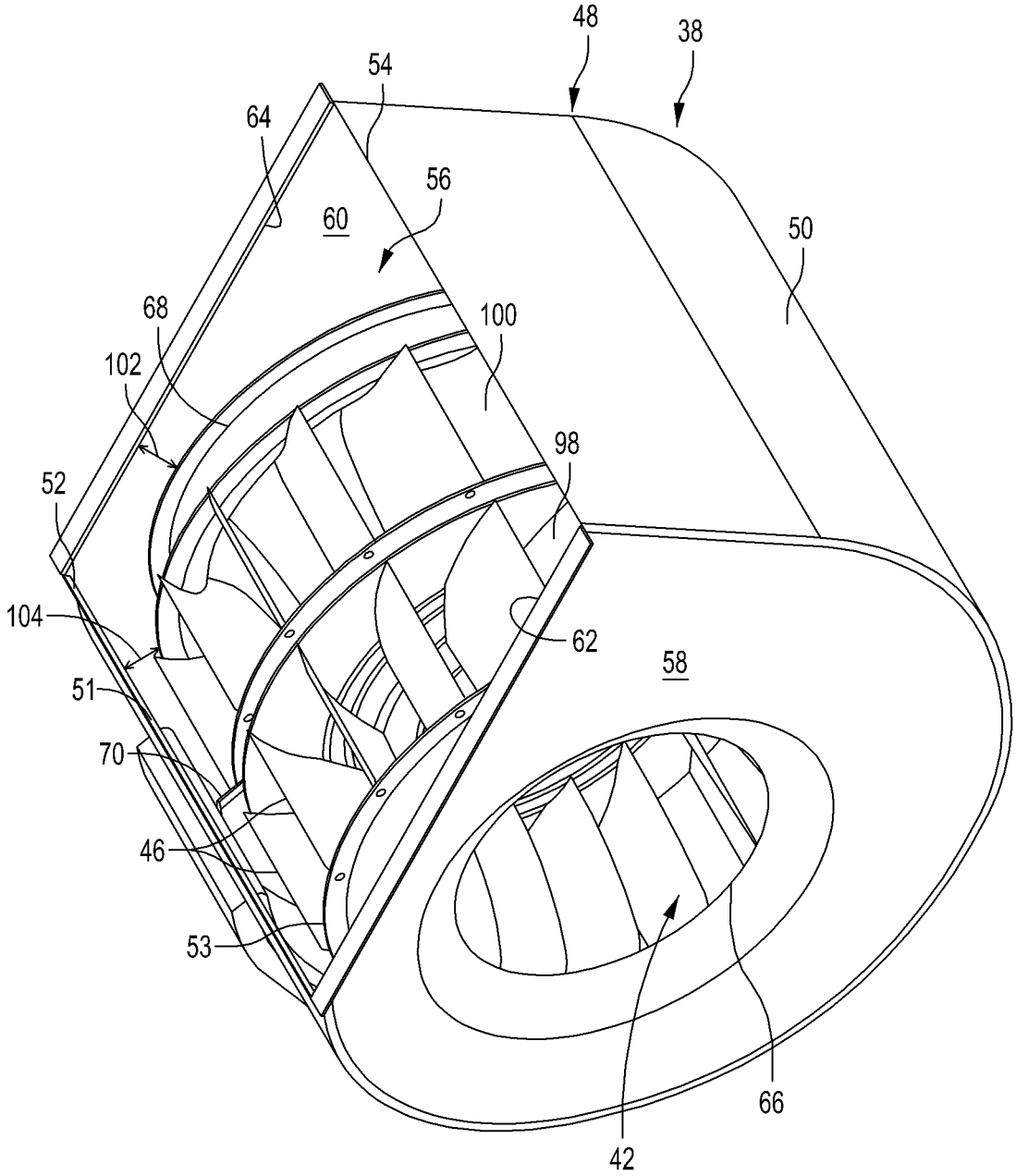
FIG. 5 is a perspective view of the blower shown in FIG. 3 revealing the outlet opening.

Referring now to FIGS. 3, 4 and 5, the blower 38 includes the fan wheel 42 that is contained with a blower housing 48. The blower housing 48 has an outer wall 50 having a scroll-shaped length that extends from a first end edge 52 of the outer wall to an opposite second end edge 54 of the outer wall 50. The outer wall first end edge 52 forms the cutoff 51 of the blower housing 48. In addition, the first end edge 52 and second end edge 54 of the outer wall 50 define opposite sides of an outlet opening 56, which is preferably but not necessarily rectangular, of the blower housing 48.

The blower housing 48 also includes first side wall 58 and second side wall 60. As seen in the FIGS. 3-5 and 7, portions of the peripheries of the first side wall 58 and the second side wall 60 are connected to the opposite sides of the outer wall 50. The first side wall 58 has a first straight edge portion 62 and the second side wall 60 has a second straight edge portion 64. The first straight edge portion 62 and second straight edge portion 64 of the first side wall 58 and the second side wall 60, respectively, are also positioned at opposite sides of the outlet opening 56 for the blower housing 48 with the outer wall 50, the first end edge 52 and the second end edge 54 defining the outlet opening 56, which preferably, but not necessarily, have a rectangular configuration. The first side wall 58 includes a first circular aperture 66, shown in FIG. 3, which is through the first side wall 58. The second side wall 60 includes a second circular aperture 68, shown in FIG. 5, which is through the second side wall 60. The first circular aperture 66 and the second circular aperture 68 are coaxially aligned and function as the air inlet openings of the blower housing 48.

Figure 6:
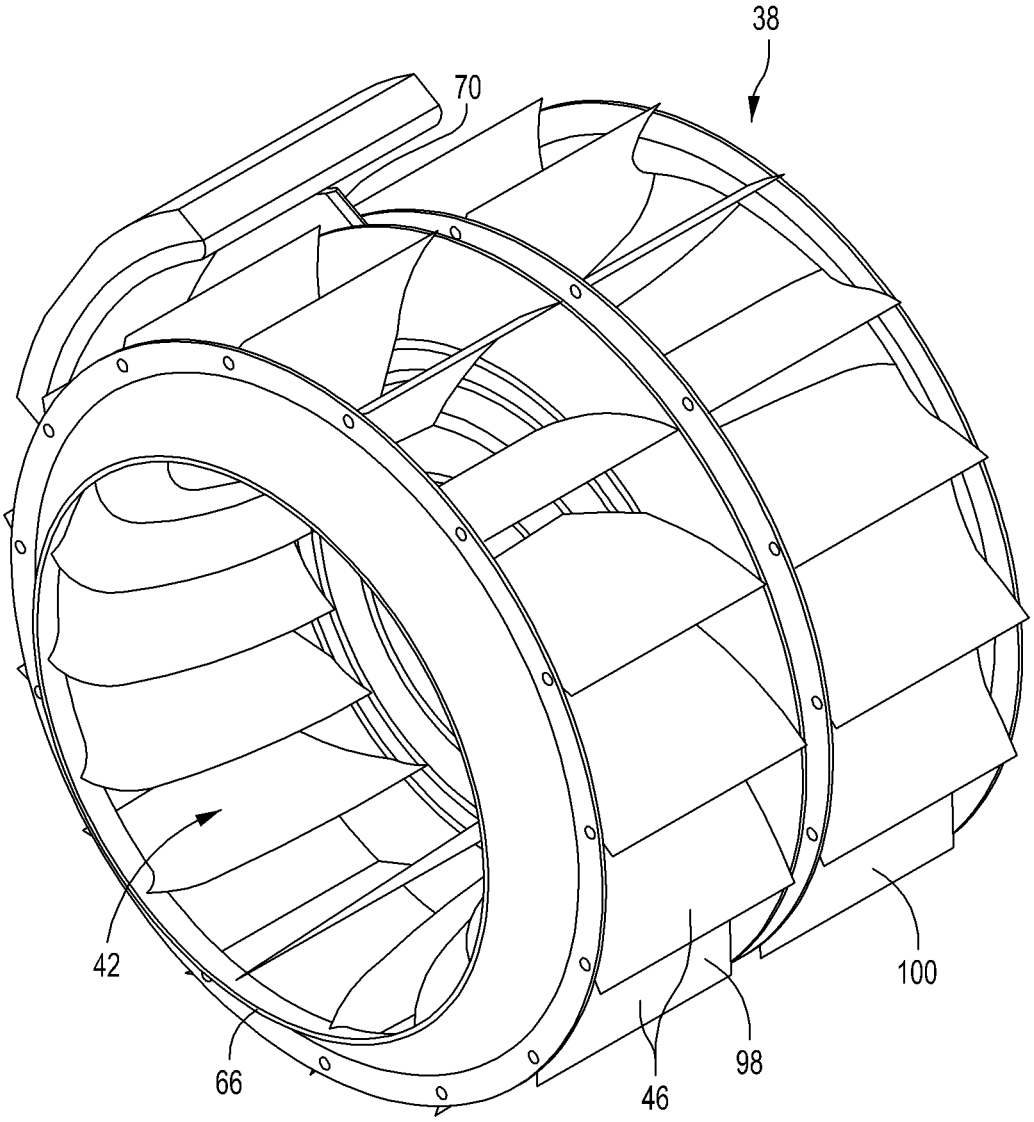
FIG. 6 is a perspective view of the blower shown in FIG. 4 without the blower housing.
Figure 7:
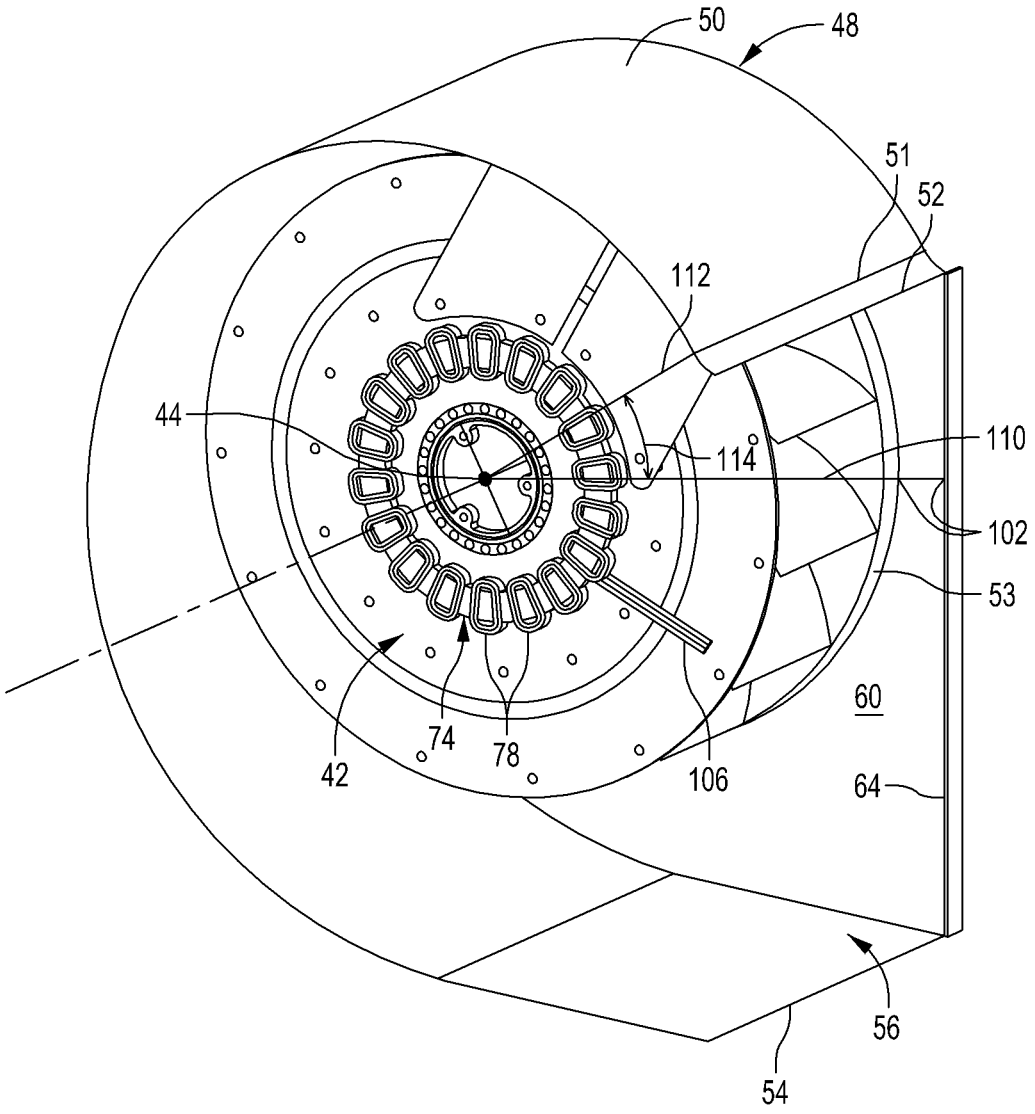
FIG. 7 is the perspective view of the blower shown in FIG. 3 with an axial flux motor with a stator and rotor.
Figure 8:
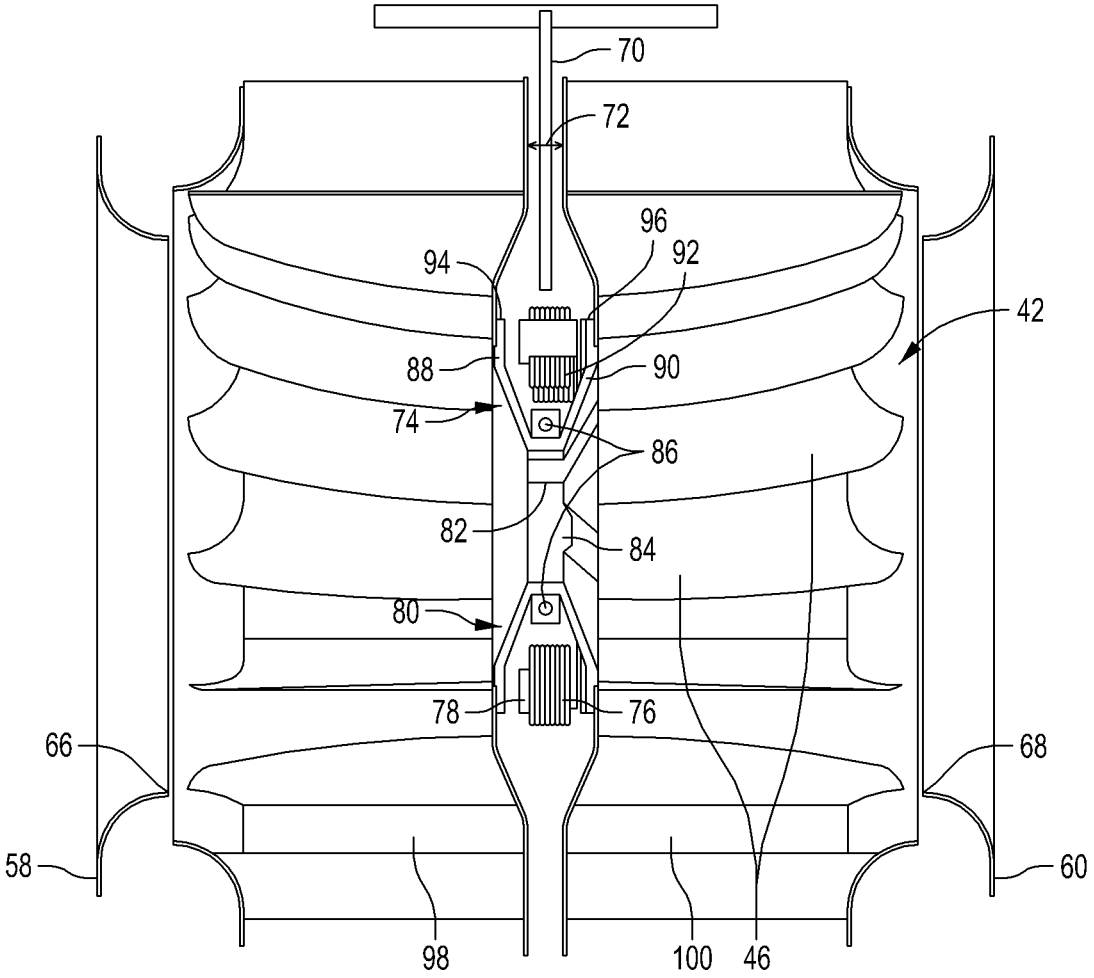
FIG. 8 is an end elevation view of the blower as shown partitioned in FIG. 7.

An interior wall 70 of the blower housing 48 is shown in FIGS. 5, 6 and 8 is utilized with a center mount motor. However, any of a wide variety of motors and mounting techniques may be utilized with the present invention. The interior wall 70 is a flat, planar wall. There is an interior wall center hole 72, preferably circular, through the interior wall 70, shown in FIG. 8. The interior wall 70 is secured to the interior surface of the outer wall 50 and is positioned in the interior of the blower housing 48 parallel to the first side wall 58 and the second side wall 60. The interior wall center hole 72 for the interior wall 70 is coaxial with the first circular aperture 66 in the first side wall 58 and the second circular aperture 68 in the second side wall 60. The interior wall center hole 72 through the interior wall 70 allows a balance of air pressure and air flow on opposite sides of the interior of the blower housing 48. In alternate embodiments, interior wall 70 could be replaced by a ring having the circular center hole 72 with the ring connected to the housing interior by three or more circumferentially spaced spokes or webs. In addition, the interior wall 70 is shown in the drawing figures centered in the blower housing 48 relative to first side wall 58 and the second side wall 60. In alternate embodiments of the invention, the interior wall 70 could be positioned off-center in the blower housing 48 and more toward one or the other of the side walls, i.e., the first side wall 58 and the second side wall 60.

Figure 9:
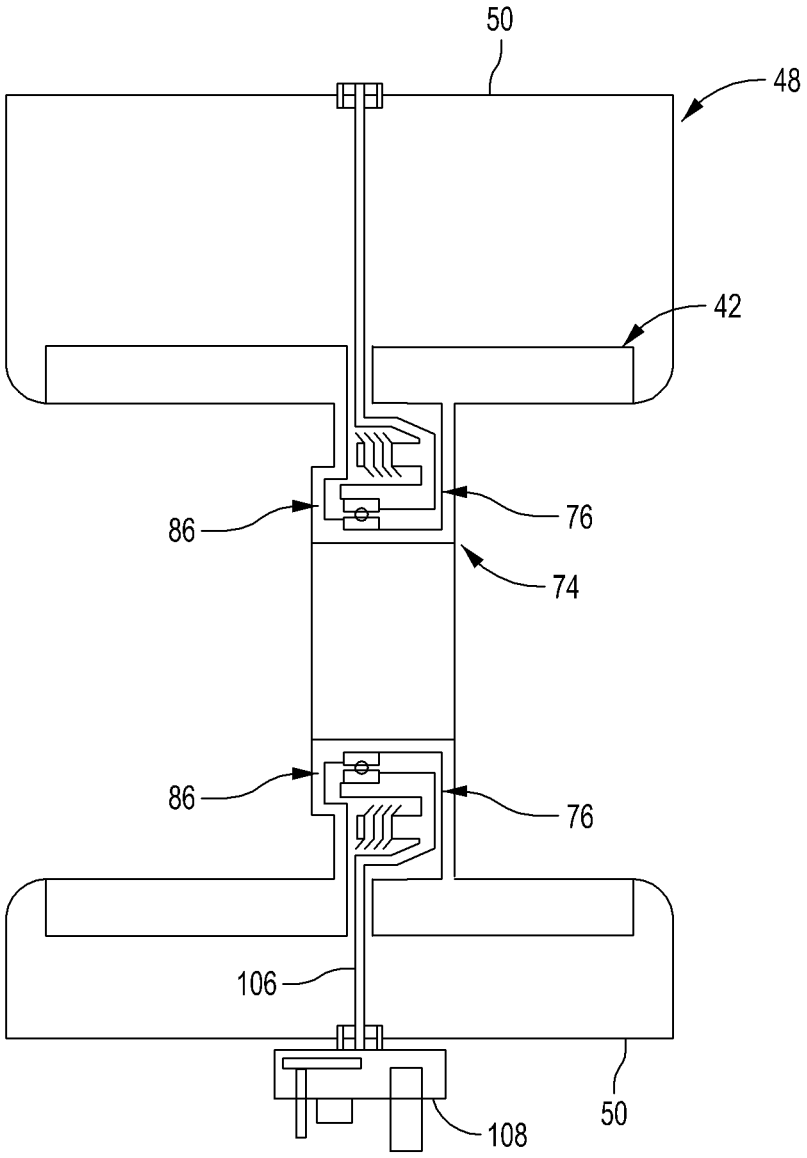
FIG. 9 is a schematic representation of an embodiment of the blower of the present invention.

Referring now to FIG. 8, the motor 74 of the blower 38 is preferably, but not necessarily, an axial flux motor. However, with this present invention any of a myriad of motors will suffice. The stator 76 of the motor 74 is integrated into the construction of the interior wall 70 at the interior wall center hole 72 through the interior wall 70. The interior wall 70 can be constructed in such a manner that allows for the wiring 106 associated with the stator 76 and the control systems of the motor 74 to be run through the interior of the interior wall 70, as shown in FIG. 9. Alternatively, the wiring 106 can be run across the exterior surface of the interior wall 70. The stator windings 78 extend radially inwardly from the interior wall 70 into the interior wall center hole 72, referring again to FIG. 8. In the illustrated, but nonlimiting, embodiment of the blower 38, the stator 76 has thirty-six (36) slots and eighteen (18) stator windings 78. The rotor 80 of the motor 74 includes a hollow cylindrical hub 82 having a bore 84 through the hollow cylindrical hub 82. The hollow cylindrical hub 82 is mounted by bearings 86 on the stator 76 for rotation of the hollow cylindrical hub 82 inside the stator 76.

As shown in FIG. 8, a pair of a first annular plate 88 and a second annular plate 90 project radially outwardly from the opposite ends of the hollow cylindrical hub 82 over opposite sides of the stator 76 and opposite sides of the interior wall 70. The bore 84 of the hollow cylindrical hub 82 defines center holes through the first annular plate 88 and the second annular plate 90. The bore 84 of the hollow cylindrical hub 82 and the holes through the first annular plate 88 and the second annular plate 90 are all coaxially aligned with the first circular aperture 66 and the second circular aperture 68 through the respective first side wall 58 and second side wall 60 of the blower housing 48. The permanent magnets 92 of the rotor 80 are secured to the interior surface of at least one of the first annular plate 88 and a second annular plate 90 that opposes the stator windings 78. In the illustrated, but nonlimiting, embodiment, thirty (30) permanent magnets 92 are employed on the rotor 80. In alternate embodiments of the blower 38, permanent magnets 92 could be provided on both of the plates, i.e., first annular plate 88 and a second annular plate 90. The first circular peripheral edge 94 for the first annular plate 88 and the second circular peripheral edge 96 for the second annular plate 90 are secured to the fan wheel 42 of the blower 38. In addition, the motor 74 need not be positioned at the center of the blower housing interior and could be positioned to either side of the interior by relocating the interior wall 70 supporting the motor 74, e.g., axial flux motor.

As also shown in FIG. 8, the fan wheel 42, which includes the backward curved impeller blades 46 of the blower 38, is formed of a first set of backward curved impeller blades 98 and a second set of backward curved impeller blades 100 with the first set of backward curved impeller blades 98 being spaced axially from the second set of backward curved impeller blades 100. The two sets of backward curved impeller blades 98 and 100 forming the backward curved impeller blades 46 are basically the same in construction. However, just as virtually any fan design can be utilized with the present invention, a single set of impeller blades can also be utilized. Although a backward curved impeller design is optimal, this invention is not limited to this type of structure.

The first set of backward curved impeller blades 98 is connected to the first circular peripheral edge 94 of the first annular plate 88 and the second set of backward curved impeller blades 100 is connected to the second circular peripheral edge 96 of the second annular plate 90. This connects the first set of backward curved impeller blades 98 and second set of backward curved impeller blades 100 to the rotor 80 with the first set of backward curved impeller blades 98 and second set of backward curved impeller blades 100 positioned on opposite sides of the interior wall 70 of the blower housing 48. On operation of the motor 74, the rotor 80 rotates freely relative to the stator 76 and drives the backward curved impeller blades 46 in rotation relative to the interior wall 70 and the blower housing 48.

The bore 84 through the hollow cylindrical hub 82 for the stator 76 allows for the balancing of pressure between the interiors of the first set of backward curved impeller blades 98 and the second set of backward curved impeller blades 100. The bore 84 also allows for the free flow of air between the interiors of the first set of backward curved impeller blades 98, the second set of backward curved impeller blades 100 and the two sides of the interior of the blower housing 48 on opposite sides of the interior wall 70.

The blower 38 as is constructed in the manner above has no obstructions to the free flow of air through the first circular aperture 66 of the first side wall 58 and the second circular aperture 68 of the second side wall 60 of the blower housing 48 into the backward curved impeller blades 46, which includes a first set of backward curved impeller blades 98 and the second set of backward curved impeller blades 100 contained in the blower housing 48. The blower housing 48 also has a smaller size than comparable prior art blower assemblies that typically have motors projecting from one side of their blower housings. This enables it to be used in a narrower air handler enclosure. This is accomplished by positioning the motor in the interior of the blower housing on the inner wall of the housing.

Referring now to FIGS. 3, 5, 6 and 8, the axis of rotation for the backward curved impeller blades 46, which includes the first set of backward curved impeller blades 98 and the second set of backward curved impeller blades 100, is indicated by numeral 44 and an outside diameter of the backward curved impeller blades 46 is indicated by numeral 53. As best shown in FIG. 4, a first distance between the outside diameter 53 of the backward curved impeller blades 46 and the outlet opening 56 is indicated by numeral 102 that extends along a vertical line 110 that extends directly from the axis of rotation 44 for the backward curved impeller blades 46. A second distance between the outside diameter 53 of the backward curved impeller blades 46 and the cutoff 51 is indicated by numeral 104 that extends along a line 112 that extends from the axis of rotation 44 for the backward curved impeller blades 46 to the cutoff 51. The first distance 102 is at a maximum less than seventy-five percent of the second distance 104. Other design options include the first distance 102 being less than fifty percent, twenty-five percent, ten percent and five percent of the second distance 104 and every variation thereof between zero percent and seventy-five percent. Optimally, the backward curved impeller blade radius 46 are as close as possible to the outlet opening 56 and it is possible for the outside diameter 53 of the backward curved impeller blades 46 to extend above the outlet opening 56. The angle 114 between line 110 and line 112 should be ten degrees or greater and may be fifteen degrees or greater, twenty degrees or greater and optimally at least thirty degrees.

Maximizing the size of the backward curved impeller blades 46 to reduce the ratio of the first distance 102 to the second distance 104 provides a significant advantage in that the revolutions per minute (rpms) are reduced which controls noise. The blower housing 48 will effectively have an oversized outlet opening 56 considerably larger than even a high efficiency blower, i.e., HEB, which will reduce pressure loss through a furnace. Furthermore, the blower 38 utilizing backward curved impeller blades 46 can be sold as a center mount motor/impeller only. Therefore, the manufacturer of the furnace can utilize a blower housing 48 that meets minimum requirements as a component of a lower blower housing cabinet in a furnace. An illustrative, but nonlimiting example, would be to have fourteen (14) inch backward curved impeller blades 46 housed in a fifteen and one-half (15.5) inch blower housing 48.

There are numerous potential ways to position the motor controls 108 for the motor 74, e.g., axial flux motor, as shown in FIG. 9. The motor controls 108 are shown mounted to the exterior of the outer wall 50 for the blower housing 48. The wiring 106 for the stator 76 extends through the interior of the interior wall 70. In other embodiments, the interior wall 70 could be replaced by a circular ring with a center opening that supports the motor 74, e.g., axial flux motor, in the same manner as the interior wall 70, with the ring being secured to the interior of the outer wall 50 of the blower housing 48 by a plurality of spokes or webs spatially arranged around the ring and extending radially from the ring to the outer wall 50 of the blower housing 48. In this variant embodiment, the wiring 106 would extend through one of the radially extending spokes or webs. The wiring 106 extending through the interior wall 70 or one of the spokes or webs provides EMI shielding of the wiring.

Nonlimiting examples of numerous other ways of mounting the motor controls 108 and running the wiring 106 are found in International Application No. PCT/US2011/044702 for "Blower Assembly with Motor Integrated into the Impeller Fan and Blower Housing Constructions," filed Jul. 20, 2011, claiming a priority of Jul. 20, 2010, which is incorporated by reference herein, in its entirety.

Furthermore, it should be understood that when introducing elements of the present invention in the claims or in the above description of the preferred embodiment of the invention, the terms "have," "having," "includes" and "including" and similar terms as used in the foregoing specification are used in the sense of "optional" or "may include" and not as "required." Similarly, the term "portion" should be construed as meaning some or all of the item or element that it qualifies.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims that follow.

The invention claimed is:

1. A blower comprising:

a blower housing having a cutoff and a top portion with an air outlet opening;

a fan within the blower housing, the fan being adapted for rotation about a fan axis and having an outer diameter with a distance between the outer diameter of the fan and the top portion of the air outlet opening extending along a vertical line between the fan axis and the air outlet opening being less than seventy-five percent of the distance between the outer diameter of the fan and the cutoff of the blower housing extending along a line between the fan axis and the cutoff; and a motor having a stator and a rotor, the rotor being rotatably coupled to the stator for rotation about the fan axis, the rotor and fan being coupled such that the fan rotates with the rotor.

2. The blower as set forth in claim 1, wherein the fan includes a plurality of impeller blades.

3. The blower as set forth in claim 1, wherein the fan includes a plurality of backward curved impeller blades.

4. The blower as set forth in claim 1, wherein the fan includes a first set of backward curved impeller blades, and a second set of backward curved impeller blades, the first set of backward curved impeller blades being spaced axially from the second set of backward curved impeller blades.

5. The blower as set forth in claim 4, further comprising an interior wall connected between the stator of the motor and the blower housing and extending generally radially from the fan axis, the interior wall supporting both the motor and the fan, the interior wall located between the first set of backward curved impeller blades and the second set of backward curved impeller blades.

6. The blower as set forth in claim 5, comprising a single bearing, the bearing attached to the interior wall and transmitting load between the rotor and the stator and transmitting load between the fan and the blower housing.

7. The blower as set forth in claim 5, wherein the interior wall comprises a wall extending radially outward from adjacent the stator to adjacent the blower housing and the wall circumscribes the stator.

8. The blower as set forth in claim 1, wherein the distance between the outer diameter of the fan and the top portion of the air outlet opening extending along a vertical line between the fan axis and the air outlet opening being less than fifty percent of the distance between the outer diameter of the fan and the cutoff of the blower housing extending along a line between the fan axis and the cutoff.

9. The blower as set forth in claim 1, wherein the distance between the outer diameter of the fan and the top portion of the air outlet opening extending along a vertical line between the fan axis and the air outlet opening being less than twenty-five percent of the distance between the outer diameter of the fan and the cutoff of the blower housing extending along a line between the fan axis and the cutoff.

10. The blower as set forth in claim 1, wherein the outer diameter of the fan extends above the top portion of the air outlet opening.

11. The blower as set forth in claim 1, wherein the rotor includes an outer diameter and an axial length, the axial length of the rotor extending along an axial extent of the fan axis, the axial length of the rotor being not more than approximately one-half of an outer diameter of the rotor.

12. The blower as set forth in claim 11, wherein the motor comprises an axial flux motor.

13. A blower comprising:

a blower housing having a cutoff and a top portion with an air outlet opening;

a fan within the blower housing, the fan being adapted for rotation about a fan axis and having an outer diameter, the fan comprising a first set of backward curved impeller blades, and a second set of backward curved impeller blades, the first set of backward curved impeller blades being spaced axially from the second set of backward curved impeller blades and a distance between the outer diameter of the fan and the top portion of the air outlet opening extending along a vertical line between the fan axis and the air outlet opening being less than seventy-five percent of the distance between the outer diameter of the fan and the cutoff of the blower housing extending along a line between the fan axis and the cutoff and the angle between the vertical line extending between the fan axis and the air outlet opening and the line extending between the fan axis and the cutoff being at least ten degrees;

a motor having a stator and a rotor, the rotor being rotatably coupled to the stator for rotation about the fan axis, the rotor and fan being coupled such that the fan rotates with the rotor; and an interior wall connected between the stator of the motor and the blower housing and extending generally radially from the fan axis, the interior wall supporting both the motor and the fan, the interior wall located between the first set of backward curved impeller blades and the second set of backward curved impeller blades.

14. The blower as set forth in claim 13, wherein the angle between the vertical line extending between the fan axis and the air outlet opening and the line extending between the fan axis and the cutoff being at least fifteen degrees.

15. The blower as set forth in claim 13, wherein the angle between the vertical line extending between the fan axis and the air outlet opening and the line extending between the fan axis and the cutoff being at least twenty degrees.

16. The blower as set forth in claim 13, wherein the angle between the vertical line extending between the fan axis and the air outlet opening and the line extending between the fan axis and the cutoff being at least twenty-five degrees.

17. The blower as set forth in claim 13, wherein the angle between the vertical line extending between the fan axis and the air outlet opening and the line extending between the fan axis and the cutoff being at least thirty degrees.

18. A method of utilizing a blower comprising:

utilizing a fan within a blower housing, having a cutoff and a top portion with an air outlet opening, wherein the fan being adapted for rotation about a fan axis and having an outer diameter with a distance between the outer diameter of the fan and the top portion of the air outlet opening extending along a vertical line between the fan axis and the air outlet opening being less than seventy-five percent of the distance between the outer diameter of the fan and the cutoff of the blower housing extending along a line between the fan axis and the cutoff; and utilizing a motor having a stator and a rotor, the rotor being rotatably coupled to the stator for rotation about the fan axis, the rotor and fan being coupled such that the fan rotates with the rotor.

19. The method of utilizing a blower as set forth in claim 18, wherein the step of utilizing a fan within a blower housing further includes utilizing a plurality of impeller blades.

20. The method of utilizing a blower as set forth in claim 18, wherein the step of utilizing a fan within a blower housing further includes utilizing a plurality of backward curved impeller blades.

21. The method of utilizing a blower as set forth in claim 18, wherein the step of utilizing a fan within the blower housing further includes utilizing a first set of backward curved impeller blades, and a second set of backward curved impeller blades, the first set of backward curved impeller blades being spaced axially from the second set of backward curved impeller blades.

22. The method of utilizing a blower as set forth in claim 21, further comprising utilizing an interior wall connected between the stator of the motor and the blower housing and extending generally radially from the fan axis, the interior wall supporting both the motor and the fan, the interior wall located between the first set of backward curved impeller blades and the second set of backward curved impeller blades.

23. The method of utilizing a blower as set forth in claim 18, further includes operating the fan, wherein the distance between the outer diameter of the fan and the top portion of the air outlet opening extending along a vertical line between the fan axis and the air outlet opening being less than fifty percent of the distance between the outer diameter of the fan and the cutoff of the blower housing extending along a line between the fan axis and the cutoff and an angle between the vertical line extending between the fan axis and the air outlet opening and the line extending between the fan axis and the cutoff being at least fifteen degrees.

24. The method of utilizing a blower as set forth in claim 18, further includes operating the fan, wherein the distance between the outer diameter of the fan and the top portion of the air outlet opening extending along a vertical line between the fan axis and the air outlet opening being less than twenty-five percent of the distance between the outer diameter of the fan and the cutoff of the blower housing extending along a line between the fan axis and the cutoff and an angle between the vertical line extending between the fan axis and the air outlet opening and the line extending between the fan axis and the cutoff being at least twenty degrees.

* * * * *